US008919896B1

(12) United States Patent
Shewchuck

(10) Patent No.: US 8,919,896 B1
(45) Date of Patent: Dec. 30, 2014

(54) PORTABLE TOOL CHEST

(71) Applicant: Lee-Ann Shewchuck, Grand Marais (CA)

(72) Inventor: Lee-Ann Shewchuck, Grand Marais (CA)

( * ) Notice: Subject to any disclaimer, the term of this patent is extended or adjusted under 35 U.S.C. 154(b) by 50 days.

(21) Appl. No.: 13/678,703

(22) Filed: Nov. 16, 2012

(51) Int. Cl.

| | |
|---|---|
| ***A47B 97/00*** | (2006.01) |
| ***F25D 25/02*** | (2006.01) |
| ***A47B 88/00*** | (2006.01) |
| ***A47B 95/00*** | (2006.01) |
| ***B65D 85/28*** | (2006.01) |
| ***A45C 3/00*** | (2006.01) |
| ***A45C 7/00*** | (2006.01) |
| ***A45C 13/22*** | (2006.01) |
| ***A45C 13/26*** | (2006.01) |
| ***A45F 5/10*** | (2006.01) |
| ***A47J 45/00*** | (2006.01) |
| ***B62B 1/00*** | (2006.01) |
| ***B62B 7/02*** | (2006.01) |
| ***B65D 85/00*** | (2006.01) |
| ***A47B 81/00*** | (2006.01) |
| *B62B 3/00* | (2006.01) |
| *B62B 11/00* | (2006.01) |

(52) U.S. Cl.
CPC ..... *B65D 85/70* (2013.01); *A47B 81/00* (2013.01)
USPC ..... 312/249.8; 312/298; 312/325; 206/373; 16/405; 280/47.35

(58) Field of Classification Search
CPC ..... B25H 3/023; B25H 3/025; B25H 3/021; B25H 3/022; B25H 3/026; B25H 3/027; B25H 3/028
USPC ..... 312/273, 249.8, 249.11, 304, 325, 298; 108/99; 220/757, 762; 206/372, 373; 16/405, 113.1, 429; 280/655, 655.1, 280/47.371
See application file for complete search history.

(56) References Cited

U.S. PATENT DOCUMENTS

| | | | | |
|---|---|---|---|---|
| 1,845,202 | A * | 2/1932 | Shriver | 312/244 |
| 1,893,527 | A * | 1/1933 | Shriver | 312/266 |
| 3,713,529 | A * | 1/1973 | Meksula | 312/272 |
| 4,733,703 | A | 3/1988 | Cimino | |
| 5,224,531 | A | 7/1993 | Blohm | |
| D361,910 | S | 9/1995 | Maple et al. | |
| 5,452,908 | A | 9/1995 | Bencic | |
| 5,901,822 | A * | 5/1999 | Tu | 190/115 |
| 6,009,598 | A * | 1/2000 | Chang | 16/113.1 |
| 6,170,839 | B1 | 1/2001 | Kizewski | |
| 6,176,559 | B1 | 1/2001 | Tiramani et al. | |
| 6,575,274 | B1 * | 6/2003 | Huang | 190/115 |
| 6,615,973 | B2 | 9/2003 | Fritter | |
| 6,766,559 | B2 * | 7/2004 | Roney et al. | 15/410 |
| 7,070,190 | B2 * | 7/2006 | Sadow | 280/37 |
| 7,571,915 | B1 | 8/2009 | Simmons | |
| 2002/0030425 | A1 * | 3/2002 | Tiramani et al. | 312/108 |
| 2004/0262867 | A1 * | 12/2004 | Arceta et al. | 280/47.35 |

(Continued)

*Primary Examiner* — Janet M Wilkens
*Assistant Examiner* — Andrew Roersma
(74) *Attorney, Agent, or Firm* — Robert C. Montgomery; Montgomery Patent & Design

(57) ABSTRACT

A large rolling tool chest includes a generally rectangular body with a hollow interior, a plurality of wheels, and an adjustable handle to facilitate organization, storage, and transportation of numerous tools of various sizes. The handle pivots to allow a user to keep it out of the way when not in use. The tool chest also includes a large pouch to hold items which are frequently used. The top of the tool chest includes two horizontally extendable drawer assemblies that fold outward and open in sections.

14 Claims, 7 Drawing Sheets

(56) References Cited

U.S. PATENT DOCUMENTS

2007/0012694 A1 1/2007 Duvigneau
2008/0190797 A1 8/2008 Good
2011/0084583 A1* 4/2011 Petrick et al. ..... 312/249.8
2011/0234059 A1* 9/2011 Ellerbe, II ..... 312/109

* cited by examiner

PORTABLE TOOL CHEST

RELATED APPLICATIONS

Not Applicable.

FIELD OF THE INVENTION

The present invention relates generally to tool chests, and in particular, to a wheeled tool chest to organize, store, and transport a plurality of tools of various sizes.

BACKGROUND OF THE INVENTION

Rolling toolboxes do an ideal job of organizing large numbers of small tools. Their mobility allows the tools to be rolled directly to the worksite, where time can be saved by eliminating frequent trips back and forth. However, their design is optimized for use with hand tools that fit into drawers. This approach does not work well with large tools or power tools such as drills and circular saws. Likewise, small tools or supplies such as screws and nails tend to get lost and fall to the bottom. Thus, while hand tools can be taken right to the job site, tools that are very large, or items that are very small require frequent trips back and forth, wasting time and money.

SUMMARY OF THE INVENTION

The inventor has recognized the aforementioned inherent problems and lack in the art and observed that there is a need for by a portable tool storage container in which all types of tools and supplies, both large and small can be transported in a rolling format without the disadvantages as described above.

Accordingly, it is an object of the present embodiments of the invention to solve at least one of these problems. The inventor has addressed this need by developing a portable tool chest that provides storage and organizational capabilities for all types of tools and supplies, both large and small, in a manner which is quick, easy and improves productivity. The inventor has thus realized the advantages and benefits of providing a generally rectangular body having a bottom, a front wall, a rear wall, a first side wall, a second side wall which forms a hollow interior space with an open top for top access to the interior space. A side opening is disposed in the first side for side access to the interior space and a side door is hingedly attached to the body for covering the side opening. A pair of horizontally extendable bottom drawers is adjustably attached to the body along a longitudinal axis by a first plurality of linkages rotatably attached between an exterior of opposing ends of the bottom drawer and an interior of the body front wall and opposing body rear wall. A pair of horizontally extendable top drawers is adjustably attached to the bottom drawers in a stacked configuration by a second plurality of linkages rotatably attached between an exterior of opposing ends of the top drawer and the exterior of opposing ends of the bottom drawer. A pair of top covers is hingedly attached to the body side walls for covering the top drawer and bottom drawer in combination. The top covers respectively engage each other when in a closed cover position. An open mouthed storage pouch is affixed to an exterior of the front wall. At least one (1) opposing pair of "L"-shaped cord posts are provided and protrude from an exterior of the second side wall for supporting a length of cord wrapped therearound. A plurality of wheels is rotatably attached to each corner of the body bottom. A handle is provided and extends generally upwardly from the body front wall and is pivotably attached to a first handle bracket and an opposing second handle bracket. A handle locking mechanism is coupled between the handle and the first bracket for locking the handle between an upright position and an outwardly angled position.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
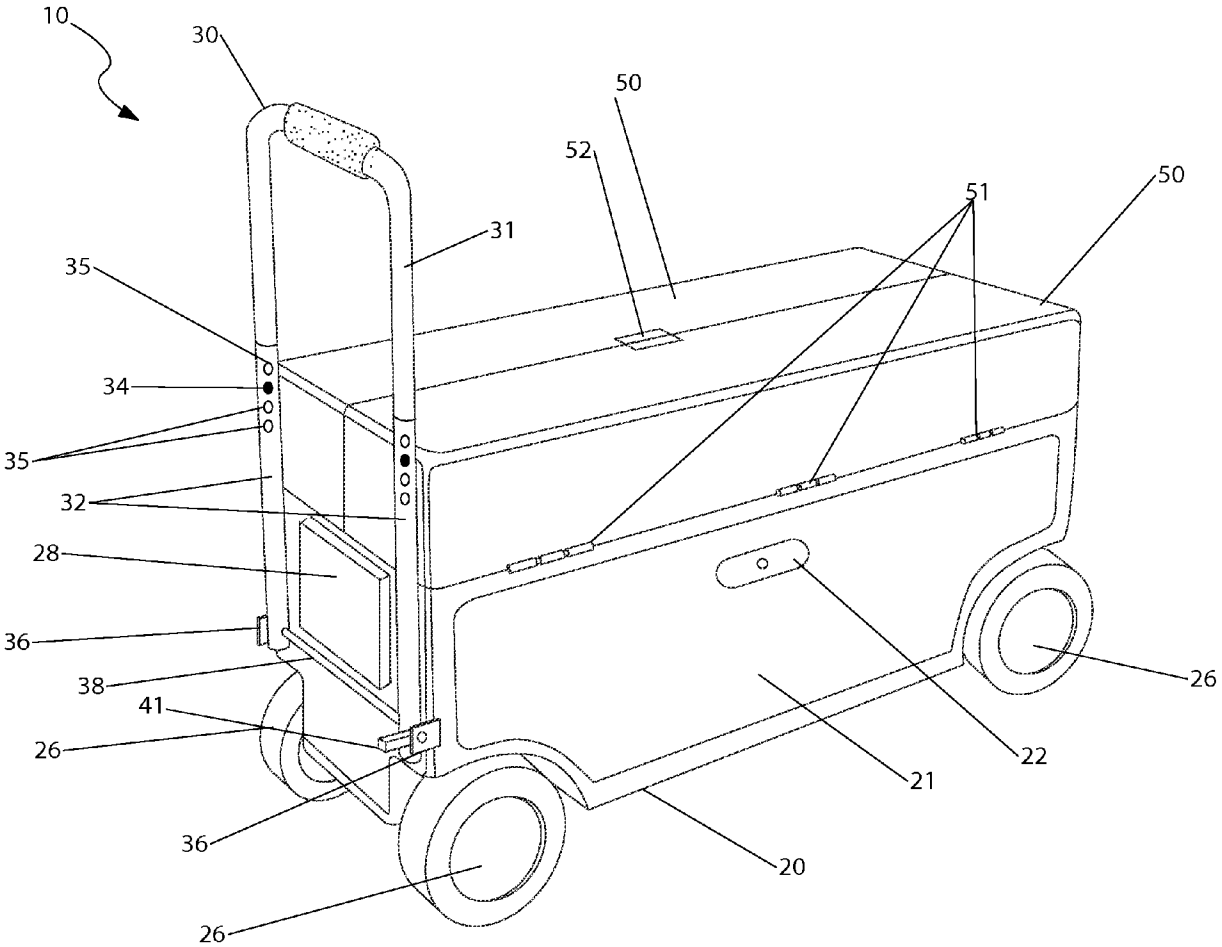
FIG. 1 is a front perspective view of a portable tool chest in accordance with the invention.

10 portable tool chest
20 body
21 side door
22 door handle
23 interior space
24 door latch
26 wheel
27 wheel axle
28 storage pouch
29 cord post
30 handle
31 handle top half
32 handle bottom half
34 spring detent pin
35 handle aperture
36 handle bracket
38 handle axle
40 handle locking mechanism
41 foot pedal
42 pedal latch
43 spring pivot
44 locking disc
45*a* first notch
45*b* second notch
50 top cover
51 cover hinge
52 cover latch

60 top drawer
61 top lid
62 bottom drawer
63 bottom lid
64*a* first rotating linkage
64*b* second rotating linkage
64*c* third rotating linkage
64*d* fourth rotating linkage

DETAILED DESCRIPTION OF THE PREFERRED EMBODIMENT

In accordance with the invention, the best mode is presented in terms of a preferred embodiment, herein depicted within FIGS. 1 through 6. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

Referring now to FIGS. 1 through 4, depicting a portable tool chest (herein described as an "apparatus") 10, where like reference numerals represent similar or like parts. In accordance with the invention, the present disclosure describes the apparatus 10 for transporting tools and other small objects to a desired location in an organized manner.

Figure 2:
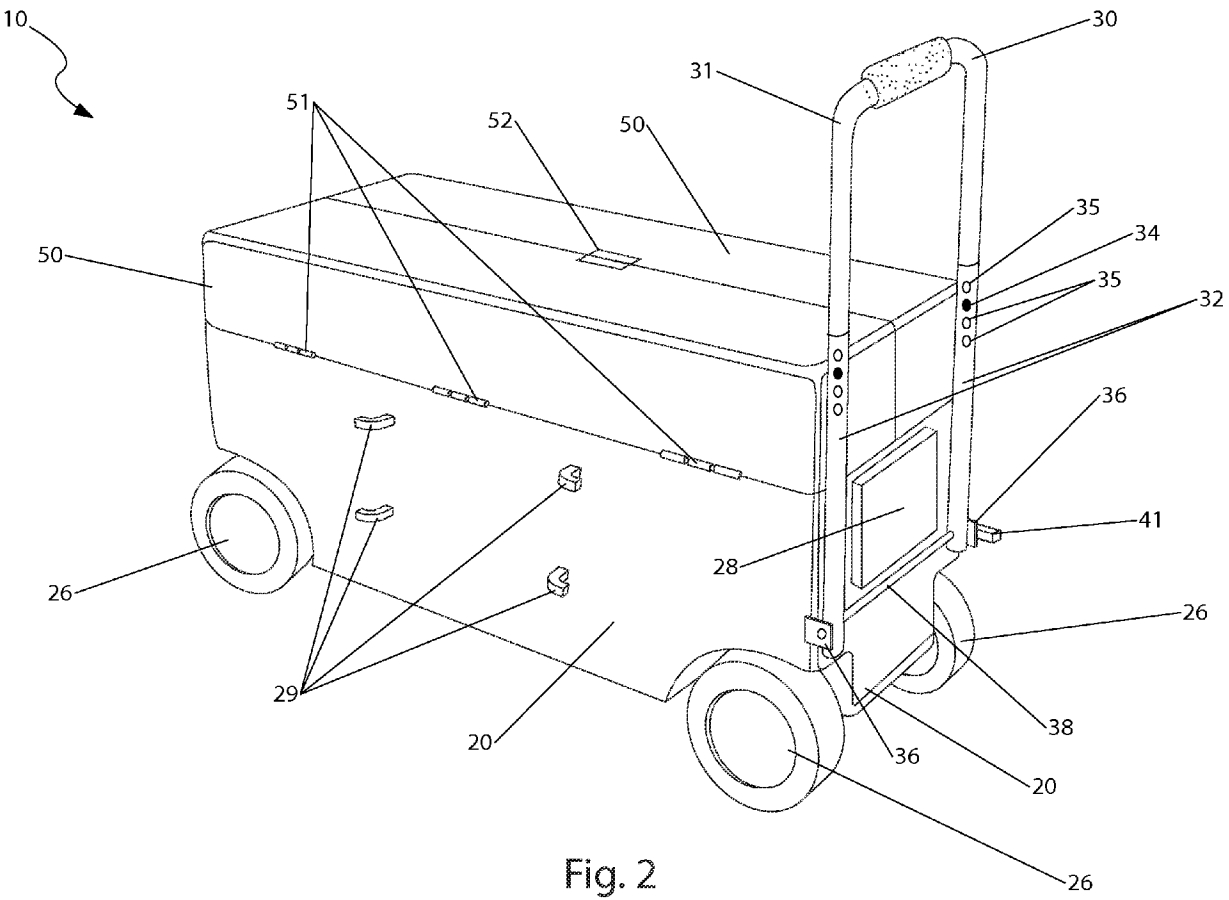
FIG. 2 is an opposing front perspective view of the portable tool chest.

FIG. 1 and FIG. 2 show opposing front perspective views of the apparatus 10. The apparatus 10 is generally a wheeled cart-type container with a variety of storage areas adapted for tools and similar small objects.

The apparatus 10 includes a tool chest main body 20 defining its lower half. The body 20 is a generally rectangular five (5) sided box structure with an open top. The body 20 includes a side door 21 along one side surface, a storage pouch 28 along a front surface, a plurality of cord posts 29 along an opposing side surface, and four (4) wheels 26. Each wheel 26 is located at each bottom corner of the body 20. The body 20 includes a hollow interior space 23 (see FIG. 3) for receiving, storing, and transporting a plurality of desired tools or associated objects. The interior space 23 is accessible by the door 21 or through the open top of the body 20. A handle 30 is attached a front end of the body 20 with a pair of handle brackets 36.

A pair of top covers 50 is attached to the upper side edges of the body 20 by a plurality of cover hinges 51. When in a closed position as shown, the top covers 50 form a contiguous and planar overall profile along with the main body 20. The top covers 50 are secured in the closed position by a cover latch 52. The cover latch 52 retains the two (2) top covers 50 in the closed position relative to each other. The top covers 50 are rotatable about the cover hinges 51, when the cover latch 52 is released, to place in an open position (see FIG. 3). The cover latch 52 is a locking mechanism, such as a latch and latch receiver with a key-actuated locking function similar to the door latch 24; although it can be appreciated that other types of locks, such as a padlock-receiving latch, can be utilized and as such should not be interpreted as a limiting factor on the invention.

The side door 21 includes a door handle 22 to allow a user to both grip the door 21 and to secure the door 21 in a closed position in order to provide security for any objects stored within the interior space 23. A lower exterior edge of the side door 21 is attached to the lower edge of the body 20 by at least one hinge. The side door 21 is rotatable to an open position along the lower exterior edge, although it can be appreciated that other door opening configurations can be utilized with similar effect and as such should not be interpreted as a limiting factor on the invention.

The storage pouch 28 is a rigid, rectangular structure having an open mouth and a hollow interior affixed to the exterior of the main body 20. The open top allows the user can place small objects within the pouch 28 and access them quickly during use without needing to access the interior space 23 of the main body 20.

Each of the plurality of cord posts 29 is a rigid "L"-shaped protrusion affixed to an exterior of the side of the main body 20 opposite the door 21. The cord posts 29 are disposed in pairs. Each pair of posts 29 is horizontally aligned facing opposite directions at a similar height along the body 20. The cord posts 29 are used to retain a coiled electrical cord, such as an extension cord.

Figure 3:
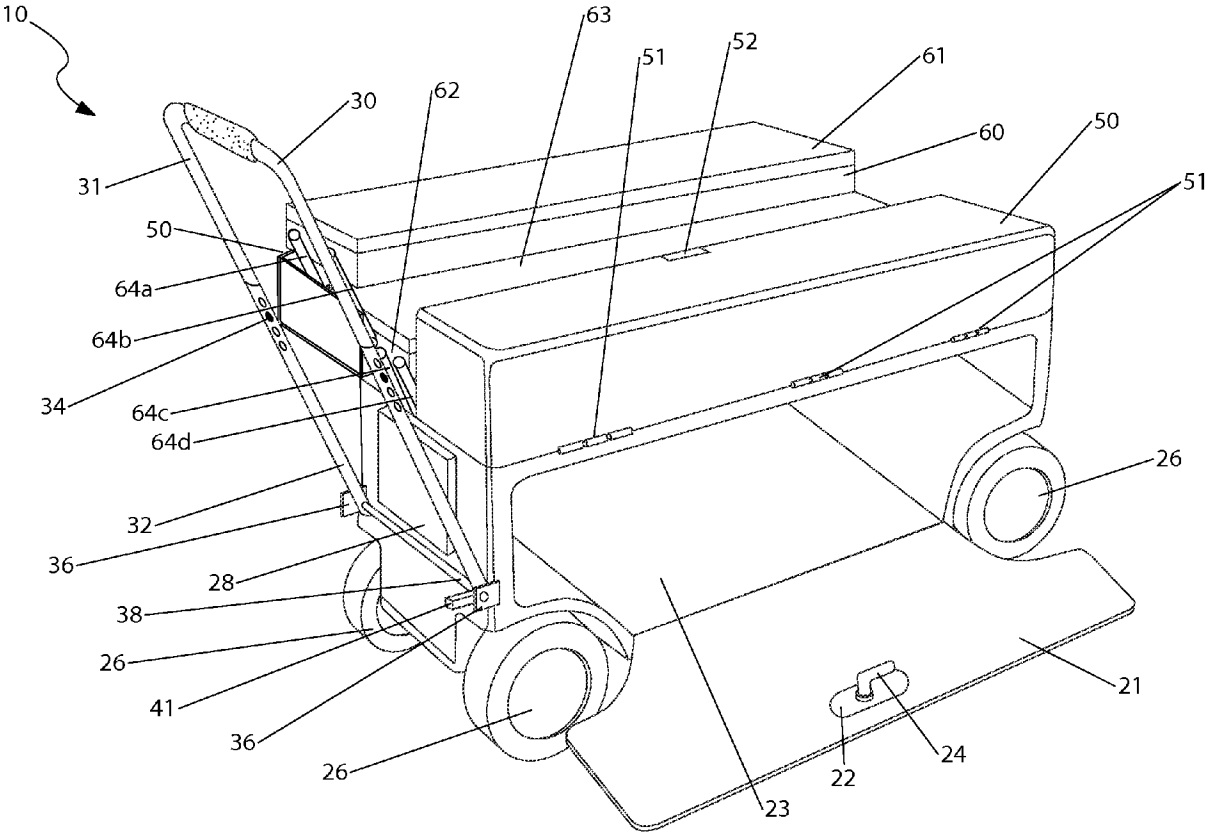
FIG. 3 is another front perspective view of the portable tool chest.

FIG. 3 shows another front perspective view of the apparatus 10 depicting the side door 21 and a single top cover 50 in the opened position. The side door 21 is shown hinged downwardly such that access to the interior space 23 is provided.

An interior side of the door handle 22 includes a door latch 24. The door latch 24 is manipulated from the exterior side of the door handle 22 using a key. When the door 21 is placed in the upright and closed position, the user inserts the key into the door handle 22 and rotates the key and the door latch 24 to engage an interior edge of the body 20 to secure the door 21 in the closed position. It can be appreciated that other types of locking mechanisms, such as a deadbolt or an electronic lock can be utilized with similar effect and as such should not be interpreted as a limiting factor on the invention.

The handle 30 is generally an inverted "U"-shaped body having a handle axle 38 passing through and rotatably attached between the two (2) free ends of the handle 30. The handle 30 rotates freely about the handle axle 38 and the handle axle 38 is held in position horizontally between the handle brackets 36. The handle brackets 36 are fastened to a front side edge of the main body 20 and retain lower ends of the handle 30 and handle axle 38. In certain embodiments, a top end of the handle 30 includes a cushioned or secure gripping surface, such as a rubber coating. In certain embodiments, the handle 30 is an adjustable, two piece handle assembly. The handle assembly includes a handle top half 31 that is slidably inserted within a handle bottom half 32. The inserting attachment allows the user to adjust and secure the handle 30 to a desired selected length (see FIG. 7).

The top cover 50 is rotated about the cover hinges 51 to expose a plurality of drawers 60, 62 and provide access to the interior space 23 through the open top of the body 20. The drawers 60, 62 are supported by a plurality of rotating linkage s 64*a*, 64*b*, 64*c*, 64*d* and are each position adjustable relative to an adjacent drawer 60, 62. The top row of rotating linkages 64*a*, 64*b* is attached at a lower end to an outer surface of a bottom drawer 62 and at an upper end to an outer surface of a top drawer 60. The lower row of rotating linkage s 64*c*, 64*d* is attached at a lower end to an upper interior surface of the body 20 and at an upper end to an outer surface of the bottom drawer 62. The drawers 60, 62 cover the open top of the body 20 and interior space 23 when in a lowered and closed position.

Figure 4:
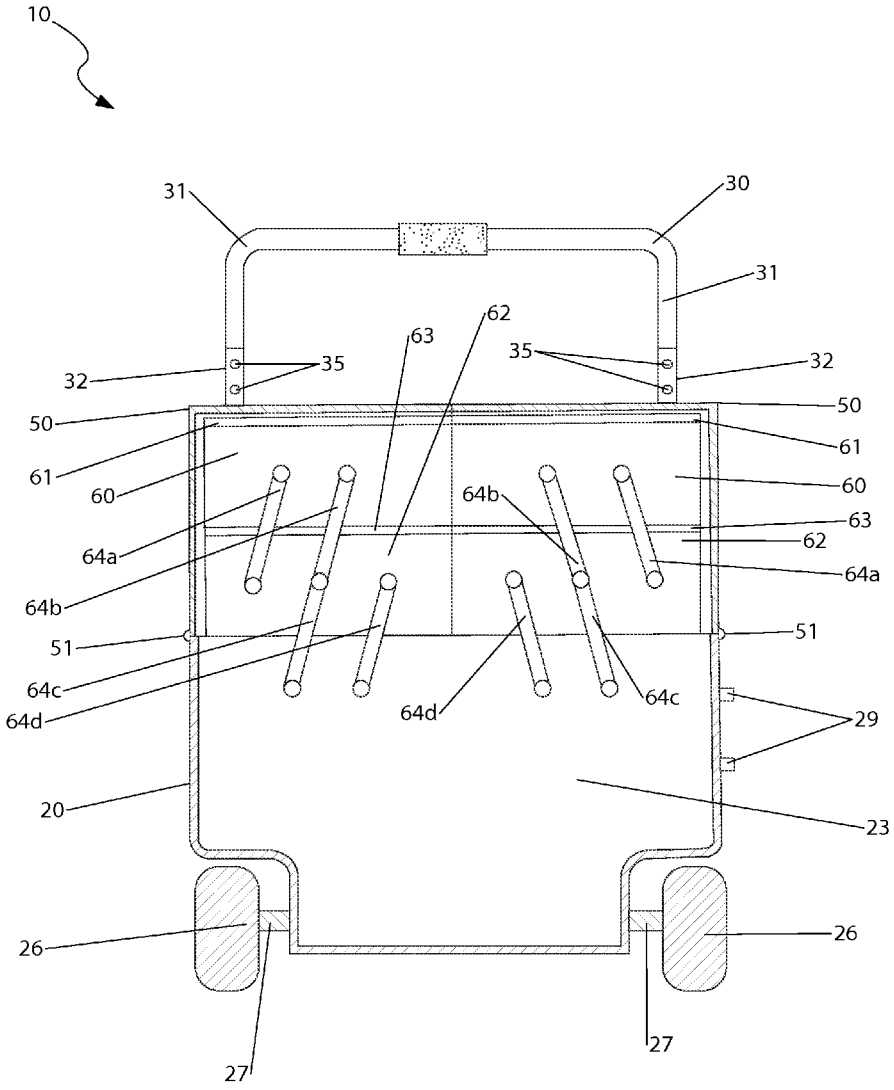
FIG. 4 is a section view of the portable tool chest in accordance with FIG. 1.
Figure 5:
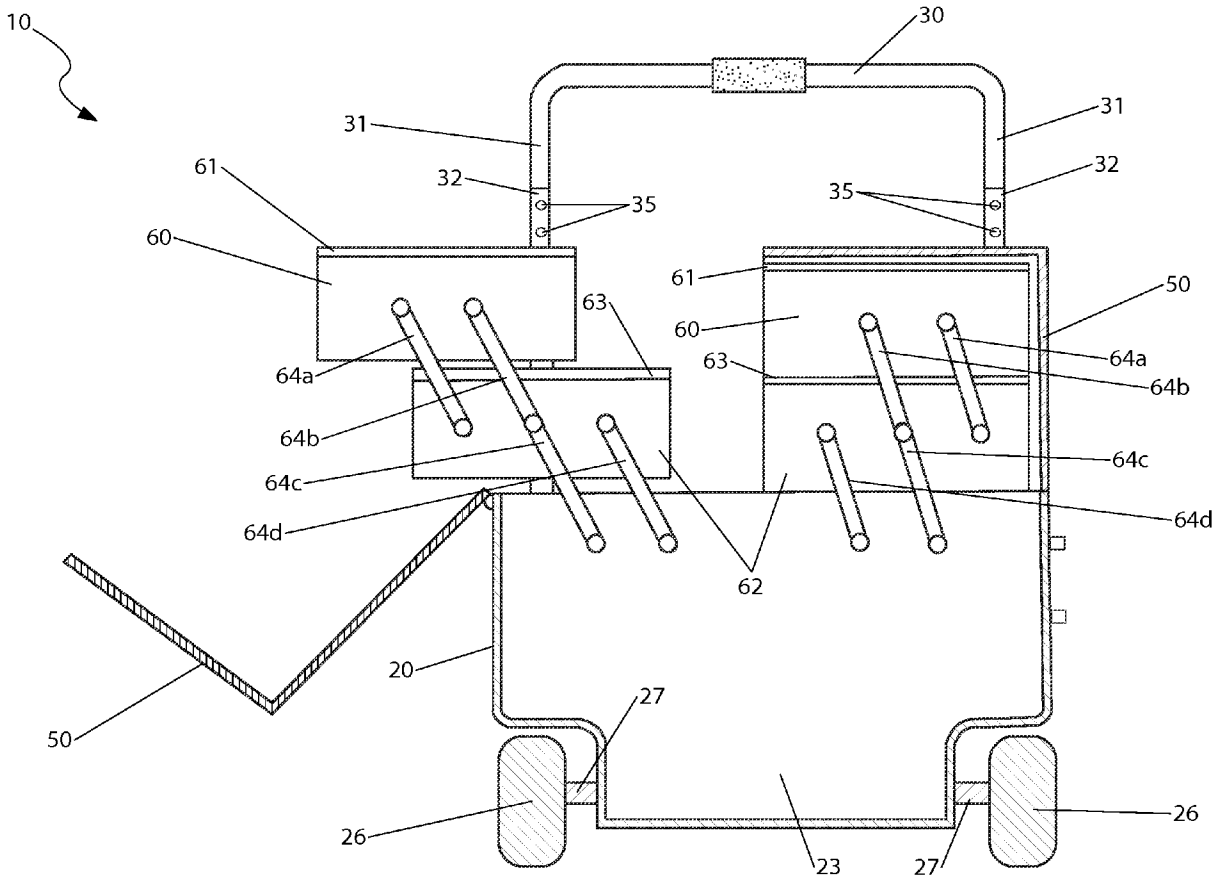
FIG. 5 is section view of the portable tool chest in accordance with FIG. 3, depicting a top drawer and a bottom drawer in an open state.

FIG. 4 shows a section view of the apparatus 10 as shown in accordance with FIG. 1 and to FIG. 5 shows a section view of the apparatus 10 as shown in accordance with FIG. 3. FIG. 5 depicts the top drawer 60 and the bottom drawer 62 in the deployed and open position. The section line in both views is taken along a line just interior of the rear surface of the body 20 to show the rotating linkage s 64*a*, 64*b*, 64*c*, 64*d* which are attached to the interior of the rear surface of the body 20.

Each wheel 26 is rotatably coupled to the bottom of the body 20 by a wheel axle 27. While depicted as a unidirectional wheel and axle assembly, it can be appreciated that in certain embodiments the wheel and axle assembly include wheel locks or swiveling wheels.

The apparatus 10 includes the two (2) separately functioning and side-by-side drawer assemblies. Each assembly includes the top drawer 60 and an associated top lid 61, the bottom drawer 62 and an associated bottom lid 63, and a plurality of rotating linkage s 64*a*, 64*b*, 64*c*, 64*d* for fastening the drawers 60, 62. Each rotating linkage 64*a*, 64*b*, 64*c*, 64*d* is rotatably fastened to either the top drawer 60 and the bottom drawer 62 or the bottom drawer 62 and an upper interior surface of the main body 20, preferably in the configuration indicated in FIG. 4. A substantially identical plurality of rotating linkage s 64*a*, 64*b*, 64*c*, 64*d* is installed along a front end of the apparatus 10 as indicated in FIG. 3.

The rotating linkages 64*a*, 64*b*, 64*c*, 64*d* are used to motion the top drawer 60 and bottom drawer 62 outwardly after the corresponding top cover 50 is opened (see FIG. 3 and FIG. 5). Each linkage 64*a*, 64*b*, 64*c*, 64*d* is at least a one linkage member pivotably attached at both ends. In certain embodiments, the first linkage 64*a* and the second linkage 64*b* pivot the top drawer 60 relative to the corresponding bottom drawer 62. The third linkage 64*c* and the fourth linkage 64*d* pivot the bottom drawer 62 relative to the body 20. The top end of the third linkage 64*c* rotates about the same axis as the corresponding second linkage 64*b*.

During use, when the top drawer 60 is pushed outwardly the top drawer 60 comes to rest in an outward position which exposes the corresponding bottom drawer 62. The bottom drawer 62 is similarly deployable independently of the top drawer 60. Once both drawers 60, 62 have been moved outward, the top drawer 60 can be moved inward and the first rotating linkage 64*a* and second rotating linkage 64*b* pivot about the bottom drawer 62 to position only the bottom drawer 62 in the deployed position. When both of the drawers 60, 62 are deployed outwardly, it provides access to the interior space 23 through the open top end of the body 20.

Each top drawer 60 and bottom drawer 62 includes the corresponding top lid 61 and bottom lid 63, respectively. The lids 61, 63 are removably attached and protect the interior of the drawers 60, 62. The drawers 60, 62 are utilized to store a desired variety of tools or other small objects in an organized manner. In certain embodiments the lids 61, 63 are removably attached to the drawers 60, 62. In certain embodiment, the drawers 60, 62 include a variety of removable or integral storage dividers or compartments in various configurations for purposes of organizing the objects contained within, such as are commonly found in toolboxes.

Figure 6:
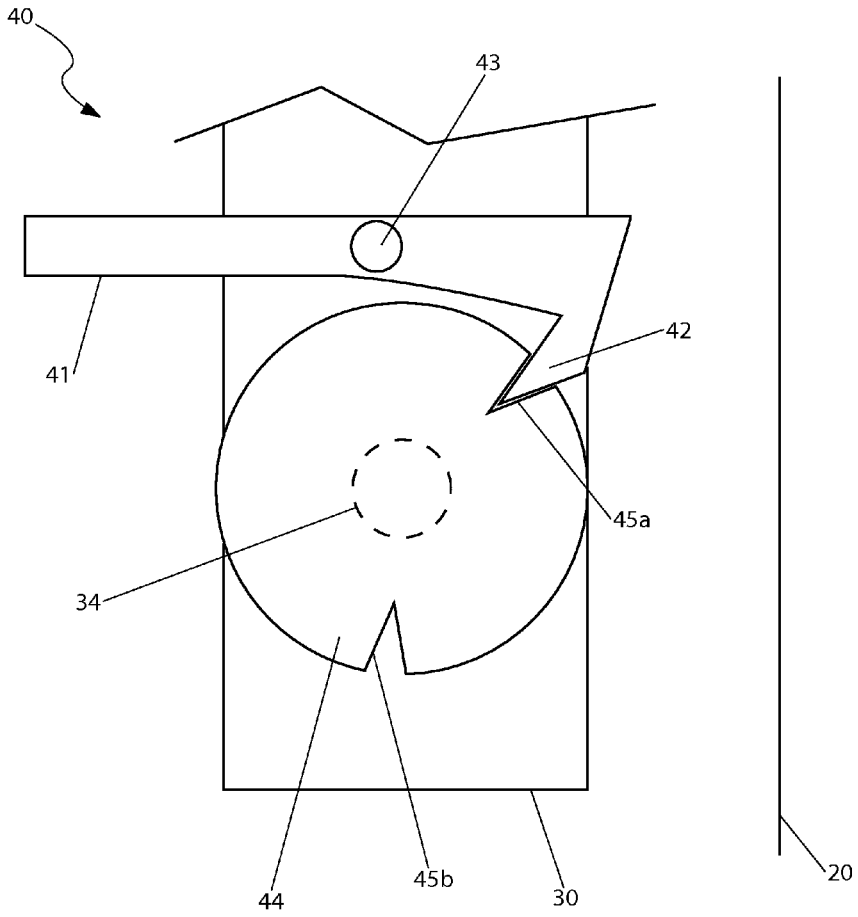
FIG. 6 is a section view of a handle locking mechanism of the portable tool chest; and, FIG. 7 is a section view of a handle of a portable tool chest.

FIG. 6 shows a sectional view of the handle locking mechanism 40 of the apparatus 10. The section line is taken along a line just interior to an inner surface of the mounting bracket 36 to show the foot pedal 41, a locking disk 44, and the lower end of the handle 30, which are attached to the mounting bracket 36, without showing the bracket 36 itself. One (1) handle locking mechanism 40 is installed between each lower end of the handle 30 and each handle bracket 36.

The handle locking mechanism 40 maintains the handle 30 securely in the upright position and in the outwardly angled position. The handle locking mechanism 40 includes the foot pedal 41 and the locking disc 44. The handle 30 is selectively unlocked in response to the foot pedal 41 being depressed and disengaging the locking disk 40. Once disengaged, the handle 30 is rotatable about the handle axle 38. The locking disc 44 is affixed to the handle 30 and rotatable about the handle axle 38. The foot pedal 41 is pivotably attached to the inner surface of the handle bracket 36. The locking disc 44 includes a first notch 45*a* and a second notch 45*b*. The foot pedal 41 also includes a pedal latch 42 disposed on an end that protrudes generally downward and inward relative to the shank of the pedal 41. The pedal latch 42 selectively engages either the first notch 45*a* or the second notch 45*b* depending upon the rotational position of the locking disc 44. In the upright, locked position, as depicted in FIG. 6, the pedal latch 42 is engaged with the first notch 45*a* so that if the user attempts to rotate the handle 30, the pedal latch 42 prevents the disc 44, and thus the handle 30, from rotating.

The pedal latch 42 disengages the selectively engaged notch 45*a*, 45*b* in response to a downward motion of the protruding front end of the food pedal 41. This causes the pedal 41 to rotate about a spring pivot 43, lifting the pedal latch 42 from within the notch 45*a*, 45*b*. The spring pivot 43 is a spring-biased cylindrical structure attached to the mounting bracket 36. When the front end of the pedal 41 is motioned downwardly, the rotating motion causes the pedal latch 42 to rotate outwardly and upwardly and to thereby disengage the first notch 45*a*. The user is then free to rotate the handle 30 downwardly about the handle axle 38.

When the user releases the foot pedal 41, the spring-biased pivot 43 causes the pedal 41 to return towards its initial position with the pedal latch 42 against the exterior circumference of the locking disc 44. If the disc 44 has been rotated to motion the first notch 45*a* away from the pedal latch 42, then the pedal latch 42 will engage a rounded exterior portion of the disc 44 and allow the user to continue to rotate the handle 30 in either direction. The spring-biased pivot 43 will further cause the pedal latch 42 to automatically engage either notch 45*a*, 45*b* when aligned properly.

The second notch 45*b* has a profile similar to the first notch 45*a* and provides a second lockable position for the handle 30. The second notch 45*b* is located such that when the user engages the second notch 45*b* with the pedal latch 42, the handle 30 is disposed at an angle which provides an ergonomic positioning for pushing and pulling the apparatus 10 for transport (see FIG. 3).

Figure 7:
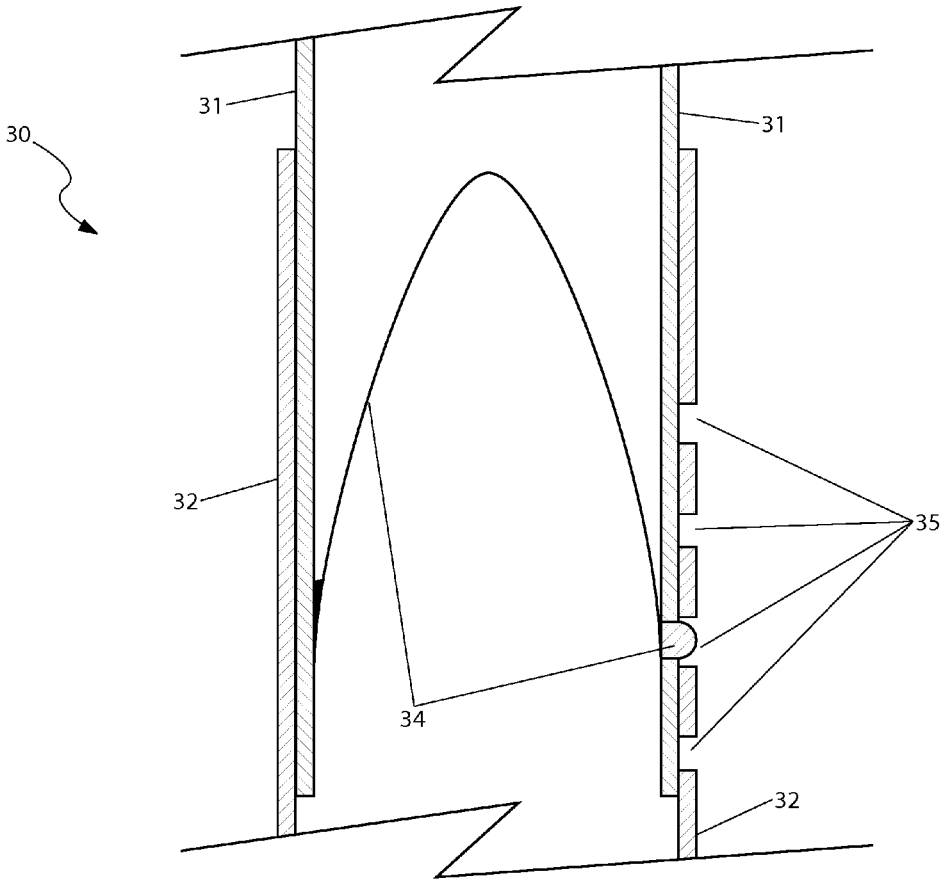

FIG. 7 shows a partial section view of the handle 30 of the apparatus 10 taken in accordance with FIG. 1. The section line is taken along a central longitudinal axis. The handle top half 31 slidably fits within the handle bottom half 32 and can be motioned within the handle bottom half 32 in a telescoping manner. The handle top half 31 includes a spring detent pin 34. The spring detent pin 34 is affixed to the handle top half 31 at one (1) end and protrudes from a pin aperture in the handle top half 31 at the other end. The protruding end of the pin 34 is biased to press outwardly against the pin aperture by a spring force but can be temporarily pushed into the interior of the handle top half 31 by applying an inward force against the protruding end of the pin 34.

The handle bottom half 32 includes a plurality of handle apertures 35 which are correspondingly sized to receive the protruding end of the spring detent pin 34. When the handle top half 31 is motioned so that the pin 34 aligns with one (1) of the handle apertures 35, the pin 34 automatically engages that handle aperture 35 due to the spring force and causes the handle top half 31 to become locked with respect to the handle bottom half 32. In this manner, the user can adjust and secure the handle 30 with a desired overall length. The user can then unlock and re-adjust the handle 30 by pressing inwardly on the pin 34 and slidingly motioning the handle top half 31 until the pin 34 engages a different handle aperture 35.

It can be appreciated by one skilled in the art that other styles and configurations of the invention can be easily incorporated into the teachings of the present disclosure and only one particular configuration has been shown and described for purposes of clarity and disclosure and not by way of limitation of scope.

In accordance with the invention, the preferred embodiment can be utilized by the user in a simple and effortless manner with little or no training. After initial purchase or acquisition of the apparatus 10, it is installed and utilized as indicated in FIGS. 1 through 7.

The method of installing and utilizing the apparatus 10 can be achieved by performing a series of steps. It can be appreciated that the steps described can be performed in alternative order and as such should not be viewed as a limiting factor. Initially the user obtains an instance of the apparatus 10. The door 21 can be opened in order to provide access to the interior space 23. The interior space 23 receives any desired combination of tools and other objects for storage and transportation. The door 21 can be locked in a closed position using the door handle 22. If the cover latch 52 is also locked, the drawers 60, 62 and the interior space 23 are completely inaccessible without unlocking either the door handle 22 or cover latch 52. This helps to prevent theft or damage to the stored items during periods of non-use.

The top covers 50 can be opened by undoing the cover latch 52 and rotating the top covers 50 about the cover hinges 51. This exposes the plurality of top drawers 60. The user can motion the top drawers 60 outwardly, which further causes the lower drawers 62 to motion outwardly in a tiered manner. This exposes the interior space 23 for insertion or removal of tools or other objects and further exposes the top lids 61 and bottom lids 63. The user can remove the lids 61, 63 to access the corresponding drawers 60, 62 in order to insert or remove a desired plurality of tools or other small objects for storage, transport, and use. The user can further store electrical cords, extension cords, or similar devices along an exterior of the apparatus 10 by winding the device around a corresponding pair of cord posts 29.

During transport, the user can depress the foot pedal 41 in order to disengage the handle locking mechanism 40 and to allow the handle 30 to rotate to a comfortable height for pushing and pulling the apparatus 10. The user can further adjust the overall length of the handle 30 by sliding the handle top half 31 and can lock the handle top half 31 in place at a desired length by engaging one (1) of the handle apertures 35 with the spring detent pin 34. The user can then roll the apparatus 10 and the contained tools and other objects to a desired location for use. Once in place, the user can lock the handle 30 in the upright position in order to keep it out of the way while working. The pouch 28 provides a storage location on the exterior of the body 20 for quick access while working.

After use, the user returns the variety of tools and other objects to their desired storage locations within the drawers 60, 62, the interior space 23, the pouch 28, or the cord posts 29. The user can then lock the door 21 and cover latch 52 prior to transporting the apparatus 10 back to a desired location for storage prior to subsequent use.

The foregoing descriptions of specific embodiments have been presented for purposes of illustration and description. They are not intended to be exhaustive or to limit the invention and method of use to the precise forms disclosed. Various modifications and variations can be appreciated by one skilled in the art in light of the above teachings. The embodiments have been chosen and described in order to best explain the principles and practical application in accordance with the invention to enable those skilled in the art to best utilize the various embodiments with expected modifications as are suited to the particular use contemplated. It is understood that various omissions or substitutions of equivalents are contemplated as circumstance may suggest or render expedient, but is intended to cover the application or implementation without departing from the spirit or scope of the claims of the invention.

What is claimed is:

1. A portable tool chest comprising:

a generally rectangular body having a bottom, a first side wall, a second side wall, a side opening in said first side wall, a front wall, and a rear wall defining a hollow interior space with an open top;

a plurality of wheel assemblies rotatably attached to said body bottom;

a side door hingedly attached to said body for covering said side opening;

a pair of drawer assemblies movably attached to said body and covering said body open top, said pair of drawer assemblies being in a side-by-side configuration, each drawer assembly comprising a bottom drawer and a top drawer, said top drawer and said bottom drawer each being horizontally movable relative to said body between a stacked configuration and an outwardly extended configuration independent of one another;

a pair of top covers hingedly attached to said body for covering said drawer assemblies, said top covers respectively engage each other in a closed position; and, a handle adjustably attached to said body;

wherein said interior space of said body is accessible from said open top when both of said top drawer and said bottom drawer are in said outwardly extended configuration; wherein said handle further comprises an inverted U-shaped member extending generally upwardly from said body and having a handle axle extending between opposing ends thereof; wherein said handle axle is rotatably attached to said front wall by a pair of handle brackets; wherein one of said handle brackets further comprises a handle locking mechanism comprising: a locking disk rigidly affixed to said handle axle comprising a first notch and a second notch disposed on an outer circumference thereof; a foot pedal pivotably attached to said one of said handle brackets comprising a downwardly protruding pedal latch disposed on an inward end; a spring affixed between said foot pedal and said one of said handle brackets for biasing said pedal latch in contact with said locking disk outer circumference; wherein said pedal latch is selectively engagable to either said first notch to selectably lock said handle in an upright position or said second notch to selectably lock said handle in an outwardly angled position.

2. The tool chest of claim 1, wherein:

said bottom drawer is adjustably attached to said body by a first plurality of linkages rotatably attached between an exterior of opposing ends of said bottom drawer and an interior of said body front wall and body rear wall; and, said top drawer adjustably attached to said bottom drawer by a second plurality of linkages rotatably attached between an exterior of opposing ends of said top drawer and said exterior of opposing ends of said bottom drawer.

3. The tool chest of claim 2, wherein:

said bottom drawer further comprises a bottom lid removably attachable to an open top thereof; and, said top drawer further comprises a top lid removably attachable to an open top thereof.

4. The tool chest of claim 1, wherein said pair of top covers is secured in said closed position by a cover latch.

5. The tool chest of claim 4, wherein said cover latch further comprises a locking mechanism.

6. The tool chest of claim 1, further comprising at least one opposing pair of "L"-shaped cord posts protruding from an exterior of said second side wall for supporting a length of cord wrapped therearound.

7. The tool chest of claim 1, wherein said handle is length adjustable further comprising a handle bottom half, a handle top half insertably attached to said handle bottom half, and a detent pin mechanism for securing said handle top half relative to said handle bottom half.

8. The tool chest of claim 1, wherein said side door further comprises a door handle for securing said door in a closed door position.

9. The tool chest of claim 8, wherein said door handle further comprises a lockable door latch.

10. The tool chest of claim 1, further comprising an open mouthed storage pouch affixed to an exterior of said front wall.

11. A portable tool chest comprising:

a generally rectangular body comprising a bottom, a front wall, a rear wall, a first side wall, a second side wall to form a hollow interior space with an open top for top access to said interior space;

a side opening disposed in said first side for side access to said interior space;

a side door hingedly attached to said body first side for covering said side opening;

a pair of horizontally extendable bottom drawers adjustably attached to said body along a longitudinal axis by a first plurality of linkages rotatably attached between an exterior of opposing ends of said bottom drawer and an interior of said body front wall and body rear wall;

a bottom lid removably attached to each bottom drawer of said pair of bottom drawers;

a pair of horizontally extendable top drawers adjustably attached to said bottom drawers by a second plurality of linkages rotatably attached between an exterior of opposing ends of said top drawer and said exterior of opposing ends of said bottom drawer;

a top lid removably attached to each top drawer of said pair of top drawers;

a pair of top covers hingedly attached to said body side walls for covering said top drawer and bottom drawer in combination, said top covers respectively engage each other in a closed position;

an open mouthed storage pouch affixed to an exterior of said front wall;

at least one opposing pair of L-shaped cord posts protruding from an exterior of said second side wall for supporting a length of cord wrapped therearound;

a plurality of wheels rotatably attached to each corner of said body bottom;

a handle extending generally upwardly from said body front wall and pivotably attached to a first handle bracket and an opposing second handle bracket; and, a handle locking mechanism coupled between said handle and said first bracket for locking said handle between an upright position and an outwardly angled position, wherein each of said top drawers and each of said bottom drawers are horizontally movable relative to said body between a stacked configuration and an outwardly extended configuration independent of one another, and wherein said interior space of said body is accessible from said open top when both of said top drawer and said bottom drawer are in said outwardly extended configuration; wherein said handle further comprises an inverted U-shaped member extending generally upwardly from said body and having a handle axle extending between opposing ends thereof and at least partially extending beyond for rotatable attachment to said handle brackets; wherein said locking mechanism further comprises: a locking disk rigidly affixed to said handle axle comprising a first notch and a second notch disposed on an outer circumference thereof; a foot pedal pivotably attached to said first handle bracket comprising a downwardly protruding pedal latch disposed on an inward end; a spring affixed between said foot pedal and said first handle bracket for biasing said pedal latch in contact with said locking disk outer circumference; wherein said pedal latch is selectively engagable to either said first notch to selectably lock said handle in an upright position or said second notch to selectably lock said handle in an outwardly angled position.

12. The tool chest of claim 11, wherein said handle is length adjustable further comprising a handle bottom half, a handle top half insertably attached to said handle bottom half, and a detent pin mechanism for securing said handle top half relative to said handle bottom half.

13. The tool chest of claim 12, wherein said side door further comprises a door handle for securing said door in a closed door position and a lockable door latch.

14. The tool chest of claim 13, wherein said pair of top covers is secured in said closed cover position by a lockable cover latch.

* * * * *